US011439882B2

(12) United States Patent
Herger

(10) Patent No.: US 11,439,882 B2
(45) Date of Patent: Sep. 13, 2022

(54) COUNTERCURRENT SWIMMING SYSTEM

(71) Applicant: Speck Pumpen Verkaufsgesellschaft GmbH, Neunkirchen a. Sand (DE)

(72) Inventor: Armin Herger, Pommelsbrunn (DE)

(73) Assignee: Speck Pompen Verkaufsgesellschaft GmbH, Neunkirchen a. Sand (DE)

( * ) Notice: Subject to any disclaimer, the term of this patent is extended or adjusted under 35 U.S.C. 154(b) by 0 days.

(21) Appl. No.: 16/999,688

(22) Filed: Aug. 21, 2020

(65) Prior Publication Data

US 2022/0054919 A1 Feb. 24, 2022

(30) Foreign Application Priority Data

Mar. 31, 2020 (DE) ..... 202020101750.0

(51) Int. Cl.
*A63B 69/12* (2006.01)

(52) U.S. Cl.
CPC ..... *A63B 69/125* (2013.01)

(58) Field of Classification Search
CPC ..... A63B 69/125; E04H 4/12; E04H 4/0006; E02H 4/1245
See application file for complete search history.

(56) References Cited

U.S. PATENT DOCUMENTS 4,665,572 A * 5/1987 Davidson ..... A61H 33/0091 4/491
4,907,304 A * 3/1990 Davidson ..... A63B 69/125 4/488
5,050,250 A * 9/1991 Morral Gispert .... A63B 69/125 4/492
5,207,729 A * 5/1993 Hatanaka ..... A61H 33/6063 4/492
5,501,582 A * 3/1996 Gautier ..... F04D 13/025 415/110
5,662,558 A * 9/1997 Shannon, III ..... A63B 69/125 4/488
6,030,180 A * 2/2000 Clarey ..... A61H 33/6063 417/18
8,162,630 B2 * 4/2012 Platt ..... F04D 13/026 417/420
10,508,462 B2 * 12/2019 Binder ..... A63B 69/125
(Continued)

FOREIGN PATENT DOCUMENTS

DE 2209507 A 9/1973
DE 2816756 A1 10/1979
(Continued)

*Primary Examiner* — Benjamin F Fiorello
(74) *Attorney, Agent, or Firm* — Day Pitney LLP; George N. Chaolas

(57) ABSTRACT

A countercurrent swimming system for swimming pools or swimming baths comprises a housing box which has at least one water inlet opening and at least one water outlet opening, a propeller for generating a water flow, which propeller is arranged in a flow channel, the flow channel opening into the at least one water outlet opening downstream of the propeller and hydraulically communicating with the at least one water inlet opening upstream of the propeller, a drive motor for the propeller. The countercurrent swimming system includes the drive motor arranged outside of the housing box and in that the propeller and the drive motor are coupled to one another via a magnetic coupling.

13 Claims, 3 Drawing Sheets

(56) References Cited

U.S. PATENT DOCUMENTS

| | | | | |
|---|---|---|---|---|
| 2002/0040869 | A1* | 4/2002 | Desjoyaux | F16L 45/00 210/167.12 |
| 2005/0262627 | A1* | 12/2005 | Jyue Chen | A61H 33/6063 4/541.6 |
| 2008/0148470 | A1* | 6/2008 | Ferriss | E04H 4/1245 4/541.1 |
| 2010/0058528 | A1* | 3/2010 | Clarey | A63B 69/125 4/492 |
| 2010/0269251 | A1* | 10/2010 | DeMotts | A63B 69/125 4/492 |
| 2015/0074895 | A1* | 3/2015 | Harder | A47K 3/10 4/492 |
| 2017/0216697 | A1* | 8/2017 | Cameron | F04D 1/00 |
| 2018/0178105 | A1* | 6/2018 | Huang | E04H 4/14 |

FOREIGN PATENT DOCUMENTS

| | | | | |
|---|---|---|---|---|
| DE | 4038501 | A1 | 6/1992 | |
| DE | 4110470 | A1 | 10/1992 | |
| DE | 29912577 | U1 | 11/2000 | |
| EP | 0017974 | A2 | 12/1980 | |
| EP | 3299627 | A1 * | 3/2018 | F04D 29/588 |
| EP | 3299627 | A1 | 3/2018 | |
| WO | 03087501 | A1 | 10/2003 | |

* cited by examiner

COUNTERCURRENT SWIMMING SYSTEM

CROSS-REFERENCE TO RELATED APPLICATION

This application claims priority to German Utility Model Patent Application No. DE202020101750.0, filed Mar. 31, 2020, which is incorporated herein by reference.

BACKGROUND

1. Field

The subject disclosure relates to a countercurrent swimming system for swimming pools or swimming baths.

2. Background of the Related Art

Numerous private or public swimming baths or swimming pools are nowadays equipped with a permanently installed or separate countercurrent swimming system, for example hooked onto the edge of the pool. Such a system generates at least one directed jet of water (also known as a "jet") in the water and usually includes a swimming bath pump (feed pump) that sucks water from the swimming bath via its suction nipple and then returns the sucked water into the swimming pool via its discharge nipple as a directed intensive jet. In some known embodiments, the discharge nipple ends in a ball jet, which makes it possible to change the direction of the exiting jet of water to a certain extent. Also, adjustable ball nozzles are known with which the volume flow/pressure ratio of the pump can be changed.

The countercurrent swimming systems, which function according to the nozzle/jet principle, initially generate a narrow, strongly directed jet of water in relation to the front cross-sectional area of the swimmer, which jet must be widened by the nozzle in such a way that the swimmer is provided a flow velocity that is uniform over the swimmer's front cross-sectional area, which flow velocity generates a similar relative movement between the water and the swimmer as is experienced when actually swimming in stagnant water. Such a countercurrent swimming system is described, for example, in the applicant's German patent application DE 2209056 A, which is incorporated herein by reference. An improved adjustable nozzle is described in the applicant's German utility model DE 20 2013 006 002 U1, which is incorporated herein by reference.

As an alternative to the countercurrent swimming systems that function according to the nozzle principle, countercurrent swimming systems have also been described in the prior art that use a propeller drive to generate the water flow. For example, US patent application US 2008/0148470 A1, which is incorporated herein by reference, describes a countercurrent system which is integrated in a swimming compartment and which has a propeller drive arranged in a flow channel to generate a strong, adjustable flow. Since the rotor of the propeller drive can have a comparatively large diameter, it is easier and more energy-efficient to use such drives to generate a flow that generates a largely uniform flow over the front cross-sectional area of a swimmer. To the side of the outlet opening for the flow generated by the propeller drive, suction openings are provided through which water from the swimming pool can enter into the flow channel, where it is accelerated by the propeller drive to generate the flow. The inlet openings are provided with a protective grille which, according to the relevant safety regulations, must not exceed certain opening widths. According to these regulations, the flow velocity of the sucked water must not exceed certain limit values.

Conventional nozzle or propeller drives for countercurrent swimming systems typically comprise an electric motor which is hermetically separated from the swimming bath water by means of suitable piping which is sealed against the swimming bath. However, there are connections to the swimming bath water via the suction and discharge nipples of the feed pump, so that when maintenance work is being carried out on the feed pump, propeller drive or drive unit, the water level of the swimming compartment must be lowered at least to the lower edge of the suction connection.

In the international patent application WO 2015/176694 A1, which is incorporated herein by reference, a countercurrent system with propeller drive is described, the drive unit of which has a brushless underwater DC motor which is arranged directly in the flow channel and therefore does not require any complex sealing devices. However, the placement of the drive motor in the flow channel is rather unfavorable in terms of flow. In addition, the performance of such motors is rather low within the safety limits in the swimming bath area.

SUMMARY

The present disclosure is therefore based on the technical problem of specifying an improved countercurrent system with a propeller drive which can also be used with powerful AC drives.

This technical problem is solved by the countercurrent swimming system having the features disclosed herein. Advantageous further developments of the countercurrent swimming system according to the disclosure are the subject of the dependent claims.

The present disclosure therefore relates to a countercurrent swimming system for swimming pools or swimming baths, comprising a housing box which has at least one water inlet opening and at least one water outlet opening, a propeller for generating a water flow, which propeller is arranged in a flow channel, the flow channel opening into the at least one water outlet opening downstream of the propeller and hydraulically communicating with the at least one water inlet opening upstream of the propeller, a drive motor for the propeller. The countercurrent swimming system according to the disclosure is characterized in that the drive motor is arranged outside of the housing box and in that the propeller and the drive motor are coupled to one another via a magnetic coupling. Due to the magnetic coupling, the propeller and motor, and thus also the motor and swimming bath water, can be galvanically separated, which increases the safety of the countercurrent swimming system.

The magnetic coupling can be implemented in different ways. The drive motor preferably has a motor shaft on which, for example, permanent magnets are arranged which couple with permanent magnets which are arranged on a drive shaft of the propeller.

On one of the shafts, the permanent magnets are designed as internal magnets, that is, they are located close to the axis on the outside of the shaft. The permanent magnets of the other shaft are designed as external magnets which surround internal magnets. For this purpose, the corresponding shaft transitions into a pot-shaped holder for the external magnets. Which of the shafts carries the internal magnets and which carries the external magnets can be selected depending on the mechanical and structural boundary conditions. In the preferred embodiment of the countercurrent swimming system according to the present disclosure, the permanent magnets of the motor shaft form the internal magnets and the permanent magnets of the drive shaft form the external magnets of the magnetic coupling.

The separation between internal magnets and external magnets in the magnetic coupling is typically carried out by means of a separating pot that separates the product area, here the swimming bath, and the surrounding area. In the countercurrent swimming system according to the present disclosure, the separating pot is preferably formed by a section of a rear of the housing box running between the permanent magnets of the motor shaft and the permanent magnets of the drive shaft.

The drive motor is advantageously flange-mounted on the rear of the housing box. Because of the magnetic coupling, it is therefore not necessary for a drive shaft/motor shaft to be guided through the rear and sealed in a complex manner.

The water inlet openings can be provided at any suitable point on the housing box that communicates with the swimming bath water. In a preferred embodiment of the present disclosure, the housing box can be integrated into a side wall of the swimming bath with its end face substantially flush. Therefore, in this embodiment, the water outlet openings and the water outlet openings are arranged on the end face of the housing box. The housing box is therefore hermetically sealed except for the end face serving for the entry and exit of the water flow.

Since water is sucked in via the water inlet openings during operation, the corresponding areas of the end face are provided with a protective grille that prevents users' body parts or longer hair from getting into the interior of the housing box. On its end face, the countercurrent swimming system is therefore preferably provided with at least one protective grille in the area of the water inlet openings.

In front of the protective grille, for aesthetic reasons, an optionally replaceable front panel can be provided, which is provided with suitable openings, which are sized in such a way that the required volume flow of the water is maintained for the operation of the countercurrent swimming system.

The flow channel is preferably defined by a flow channel housing which opens into the at least one outlet opening and which, upstream of the propeller, has lateral openings for the entry of water into the flow channel. According to a preferred embodiment of the present disclosure, an adjustable ball nozzle can also be arranged at the outlet opening, which makes it possible to adjust the outlet angle of the water flow generated by the propeller.

Due to the hermetic separation of the drive motor and swimming bath water, there are no special safety-critical requirements for the drive motor of the countercurrent swimming system according to the present disclosure. Therefore, powerful single-phase or three-phase AC motors can also be used as drive motors.

In one embodiment, at least one additional suction nipple is provided on the rear of the housing box, via which water can be sucked in from an area of the swimming compartment further away from the countercurrent swimming system. The suction nipple can be designed as an optionally usable adhesive nipple.

According to a further embodiment, at least one circulation nipple can be provided on the rear of the housing box, via which a slight, continuous or periodic circulation can be maintained when the countercurrent swimming system is not in use, for example to avoid stagnant water in the housing box or as active frost protection.

The present disclosure also relates to a swimming bath with a corresponding countercurrent swimming system according to the present disclosure integrated into a side wall of the swimming bath. The drive motor of the propeller of the countercurrent swimming system is preferably arranged in a maintenance shaft of the swimming bath, where it is easily accessible for maintenance purposes without the water in the swimming bath having to be partially drained off.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
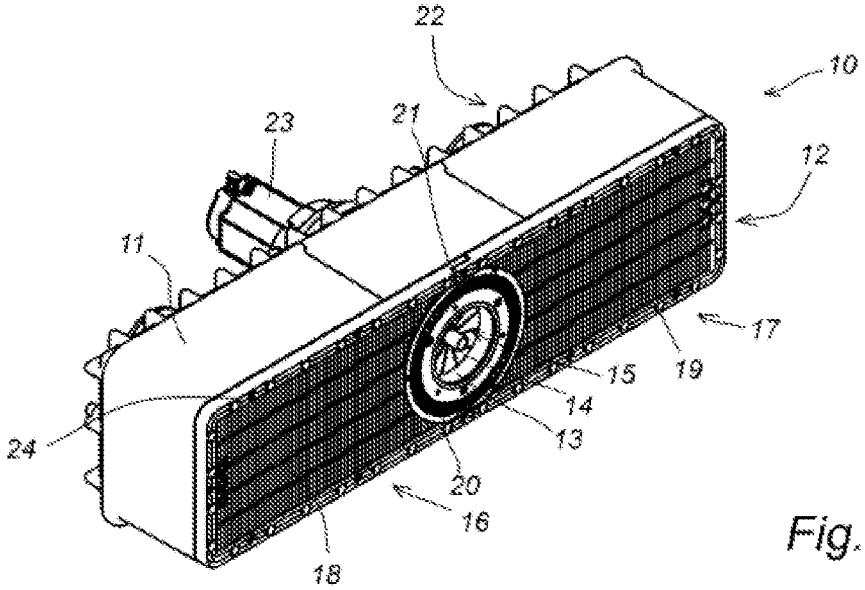
FIG. 1 shows a perspective view of an embodiment of the countercurrent swimming system according to the present disclosure.

The subject technology overcomes many of the prior art problems associated with

The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements. It is understood that references to the figures are with respect to the figures and not meant in a limiting sense.

FIG. 1 shows a countercurrent swimming system according to the present disclosure, denoted overall by the reference numeral 10, in the non-installed state. The illustrated embodiment of the countercurrent swimming system 10 has an essentially rectangular housing box 11, the end face 12 of which has a central outlet opening 13 into which a flow channel 14 opens, in which, behind a star-shaped protective grille, a propeller 15, not directly apparent in the illustration of FIG. 1, is arranged for the generation of a water flow. Inlet openings 16, 17, which are covered by plastic protective grilles 18, 19, are provided to the side of outlet opening 13. A drive motor 23 for the propeller 15 is flange-mounted on the rear 22 of the housing box. The housing box 11 is inserted into a correspondingly recessed opening in a side wall of the swimming compartment (not shown here) in such a way that the upper edge 24 of the end face 12 is below the surface of the water during operation. In the installed state, the end face 12 of the housing box of the countercurrent swimming system 10 is substantially flush with the corresponding inner wall of the swimming compartment.

Figure 2:
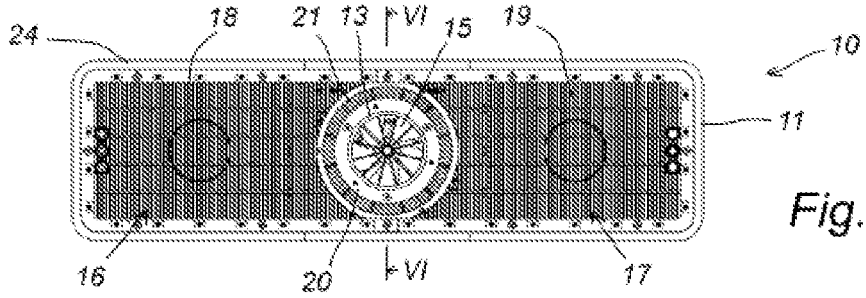
FIG. 2 shows a frontal view of the countercurrent swimming system of FIG. 1.

FIG. 2 shows a front view of the end face 12 of the countercurrent swimming system 10 of FIG. 1, components which have already been described in connection with FIG. 1 being denoted by the same reference numerals. In this illustration, the propeller 15 is more apparent than in FIG. 1. As can be seen in particular from the front view of FIG. 2, the central outlet opening 13 is surrounded by a central protective grille 20 in which radial slots 21 are recessed for the entry of swimming bath water. The central protective grille 20 can be detached separately from the lateral protective grilles 18, 19, so that the propeller 15 is more easily accessible for maintenance purposes.

Figure 3:
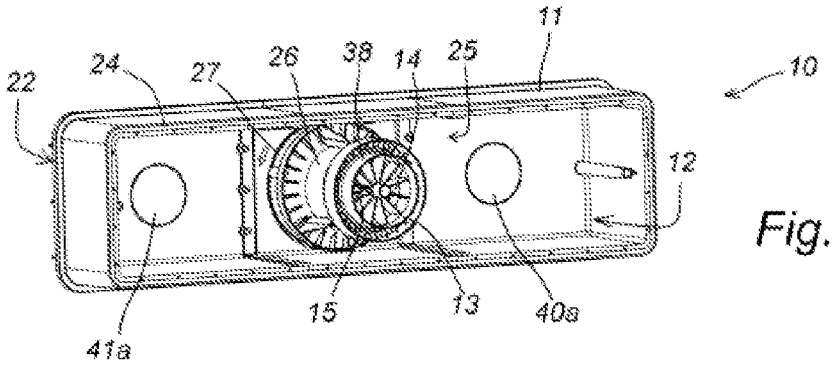
FIG. 3 shows a perspective view of the countercurrent swimming system of FIG. 1 without a protective grille.

FIG. 3 shows a perspective view of the countercurrent swimming system 10 of FIG. 1 with the end face 12 open, i.e., without the lateral protective grilles 18, 19 and without the central protective grille 20. In particular, a central flow channel housing 26 attached to the inner wall 25 of the rear 22 can be seen which defines the flow channel 14 in which the propeller 15 is arranged. In the rear part of the flow housing 26, circumferential openings 27 are provided, into which the swimming bath water flowing into the housing box 11 via the inlet openings 16, 17 can be sucked into the flow channel, and discharged again via the outlet opening 13 as a countercurrent.

Figure 4:
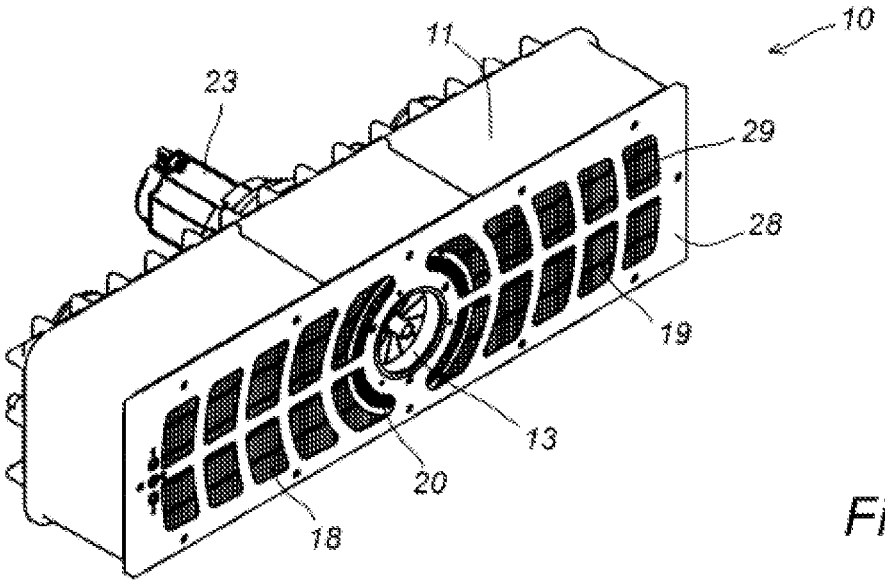
FIG. 4 shows a variant of the countercurrent swimming system of FIG. 1 with a front panel.
Figure 5:
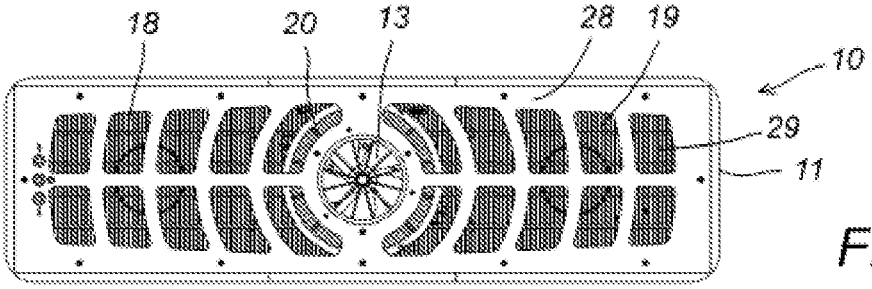
FIG. 5 shows a frontal view of the countercurrent swimming system of FIG. 4.

FIGS. 4 and 5 show a variant of the countercurrent swimming system of FIGS. 1 to 3, in which the end face 12 is covered with a front panel 28, which can consist of stainless steel, for example, and in which openings 29 are recessed, through which the protective grilles 18-20 are apparent. On the one hand, the panel 28 must not hinder the water flowing in and out, but on the other hand it can be designed in such a way that the aesthetic appearance of the countercurrent swimming system is increased.

Figure 6:
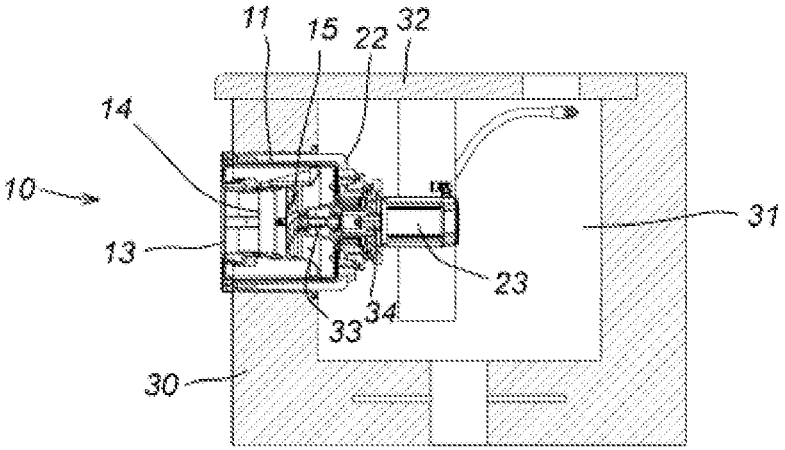
FIG. 6 shows a cross section of the installed countercurrent swimming system of FIGS. 1 and 2.

FIG. 6 shows a cross section of the countercurrent swimming system of FIGS. 1-3 along the line VI-VI of FIG. 2 in the installed state. The same components as in FIGS. 1-5 are again denoted by the same reference numerals. The housing box 11 is apparent in which the flow channel housing 26 is arranged, which defines the flow channel 14 in which the propeller is arranged. The housing box 11 is embedded in a side wall 30 of a swimming compartment (not shown otherwise). The drive motor 23 flange-mounted on the rear 22 of the housing box 11 is accessible via a maintenance shaft 31 which is closed off by a removable cover 32.

A special feature of the countercurrent swimming system according to the present disclosure is that the housing box 11 is hermetically sealed on the end face 12, except for the water inlet and outlet openings. In particular, the drive shaft 33 of the propeller 15 does not pass through the rear 22 of the housing box 11. Maintenance work can therefore be carried out on the drive motor 23 via the maintenance shaft 31 without having to drain the swimming bath water to a level below the suction openings of the housing box. In addition, powerful AC drives (for example a three-phase 400 V AC drive motor) can be used to drive the propeller 15 without any risk of endangering the swimmers in the swimming compartment. The coupling of the motor 23 to the propeller 15 takes place via a magnetic coupling, so that a hermetic separation of the motor and swimming bath water is ensured.

Figure 7:
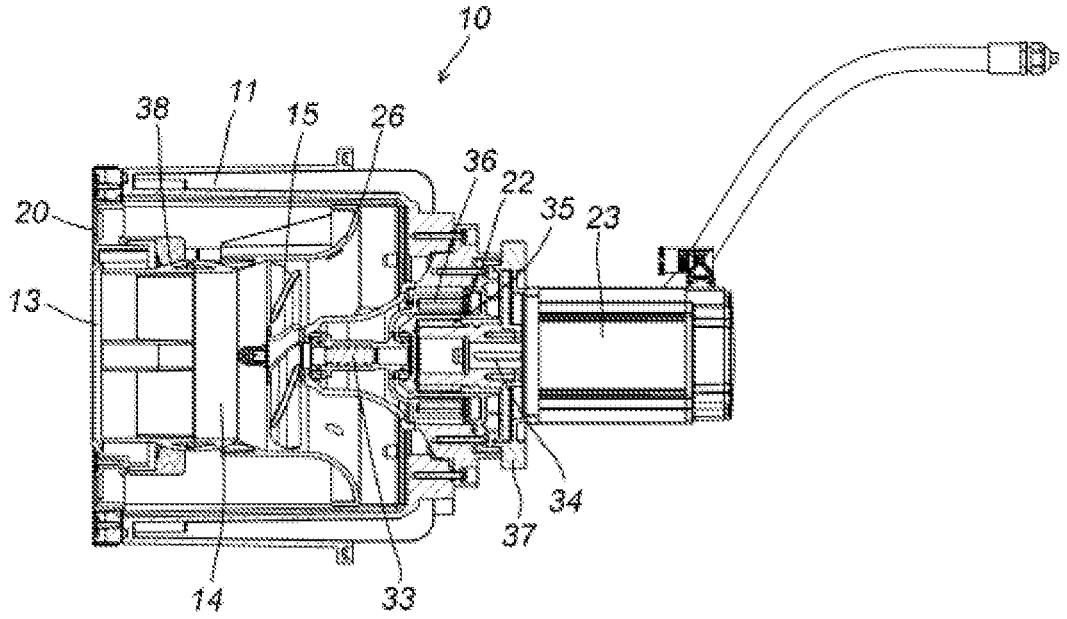
FIG. 7 shows an enlarged cross section of the non-installed countercurrent swimming system of FIGS. 1 and 2.

The magnetically coupled propeller drive is apparent more clearly in particular in the detailed, enlarged cross-sectional drawing in FIG. 7. On a motor shaft 34 of the drive motor 23, internal magnets 35 connected to the motor shaft 34 are arranged in a rotationally fixed manner, which magnetically couple with external magnets 36 which are connected to the shaft of the propeller 15. A section of the rear 22 of the housing box runs between the external magnets 36 and the internal magnets 35, so that the hermetic separation of the motor 23 and the propeller 15 rotating in the swimming bath water is ensured. The motor 23 is connected to the rear 22 of the housing box 11 via a connection flange 37. In the illustration in FIG. 7 it is apparent that a ball nozzle 38 is provided in the flow channel 14 at the water outlet opening 13, via which the outlet angle of the water flow generated by the propeller 15 can be adjusted within certain limits.

Figure 8:
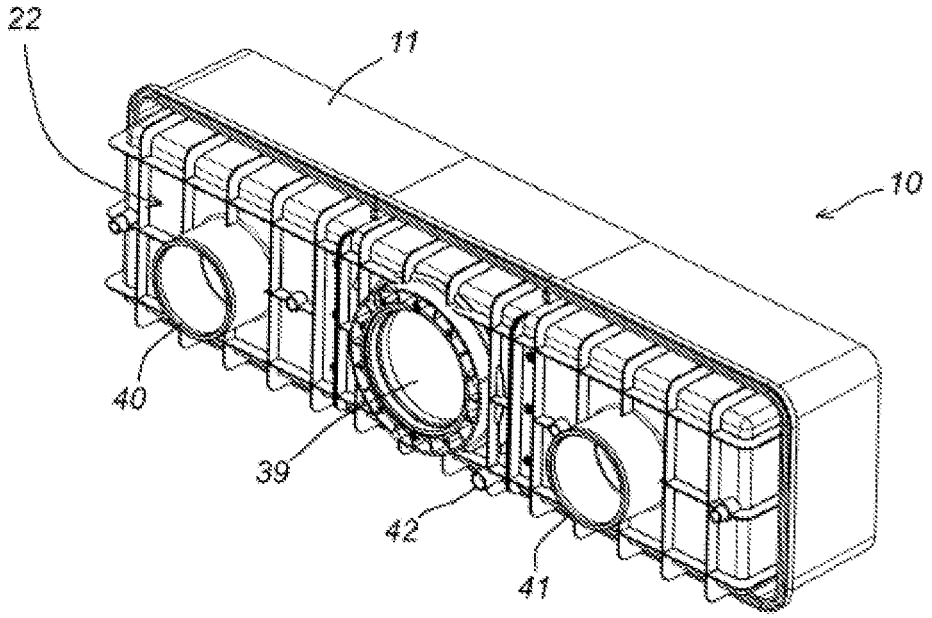
FIG. 8 shows a perspective view of the rear of the countercurrent swimming system of FIG. 1.

FIG. 8 shows a further perspective view of the countercurrent swimming system 10 of FIG. 1, the viewing angle being selected such that in particular the rear 22 of the housing box 11 is apparent more clearly. In the middle area of the rear 22, a central opening 39 is provided, on the outer circumference of which the drive motor of the propeller (not shown here) can be flange-mounted. It is also apparent that in this embodiment of the countercurrent swimming system, two further suction nipples 40, 41 are provided on the rear 22 of the housing box 11, which suction nipples in the example shown are designed as optional adhesive nipples. Via the suction nipples 40, 41, an additional suction facility can optionally be created via suitable pipe connections in order to suck in water from other parts of the swimming compartment, for example from the opposite side of the swimming compartment. When using the additional suction nipples, the rear 22 can be broken open in corresponding suction opening areas 40*a*, 41*a* on the inner wall 25 of the rear 22 (see FIG. 3) in order to establish a connection between the suction nipples 40, 41 and the interior of the housing box 11. If the suction nipples 40, 41 are not used, the corresponding areas 40*a*, 41*a* of the inner wall 25 remain closed.

The embodiment shown in FIG. 8 also has a circulation nipple 42, which can be connected to a corresponding outlet nipple opening into the swimming bath via a feed pump, for example a circulation pump (not shown) that is usually provided in the swimming bath anyway, and suitable piping (also not shown). The circulation nipple 42 can be sized relatively small and primarily serves to ensure active circulation when the countercurrent swimming system is not used for a long time, in particular when the swimming bath is not in use. For example, by maintaining a periodic, slight circulation, stagnant water in the housing box 11 can be avoided. Another possible application of the circulation nipple 42 is in the area of frost protection, where circulation is maintained at low temperatures (so-called "active winter storage").

LIST OF REFERENCE NUMERALS

10 countercurrent swimming system
11 housing box,
12 end face of the housing box 11
13 water outlet opening
14 flow channel
15 propeller
16 water inlet openings
17 water inlet openings
18 lateral protective grille
19 lateral protective grille

20 central protective grille
21 radial slots
22 rear of the housing box 11
23 drive motor
24 upper edge of end face 12
25 inner wall of the rear 22
26 flow channel housing
27 lateral openings
28 front panel
29 opening in the front panel
30 side wall of a swimming compartment
31 maintenance shaft
32 cover
33 drive shaft of propeller 15
34 motor shaft
35 internal magnets
36 external magnets
37 flange
38 ball nozzle
39 central opening
40, 41 suction connection
40*a*, 41*a* suction opening area
42 circulation connection It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements in a particular implementation.

All patents, patent applications and other references disclosed herein are hereby expressly incorporated in their entireties by reference.

While the subject technology has been described with respect to preferred embodiments, those skilled in the art will readily appreciate that various changes and/or modifications can be made to the subject technology without departing from the spirit or scope of the invention as defined by the appended claims.

The invention claimed is:

1. A countercurrent swimming system for swimming pools or swimming baths, comprising:

a rectangular housing box having an end face, said end face being provided with a central water outlet opening and a left-side water inlet opening extending to the left of said water outlet opening and a right-side water inlet opening extending to the right of said water outlet opening, wherein a width of said left-side water inlet opening and a width of said right-side water inlet opening are each at least twice the diameter of said central water outlet opening;

a propeller for generating a water flow which is arranged in a flow channel, the flow channel opening into the central water outlet opening downstream of the propeller and hydraulically communicating with said left-side and said right-side water inlet openings upstream of the propeller;

and a drive motor for the propeller, wherein the drive motor is arranged outside of said rectangular housing box and wherein the propeller and the drive motor are coupled to one another via a magnetic coupling.

2. The countercurrent swimming system according to claim 1, wherein the drive motor has a motor shaft on which permanent magnets are arranged which couple with permanent magnets which are arranged on a drive shaft of the propeller.

3. The countercurrent swimming system according to claim 2, wherein the permanent magnets of the motor shaft form the internal magnets and the permanent magnets of the drive shaft form the external magnets of the magnetic coupling.

4. The countercurrent swimming system according to claim 2, wherein a section of a rear of the housing box runs between the permanent magnets of the motor shaft and the permanent magnets of the drive shaft.

5. The countercurrent swimming system according to claim 4, wherein the drive motor is flange-mounted on the rear of the housing box.

6. The countercurrent swimming system according to claim 1, wherein the end face comprises at least one protective grille.

7. The countercurrent swimming system according to claim 6, wherein a front panel is arranged in front of the protective grille.

8. The countercurrent swimming system according to claim 7, wherein the flow channel is defined by a flow channel housing which opens into the at least one outlet opening and which, upstream of the propeller, has lateral openings for the entry of water into the flow channel.

9. The countercurrent swimming system according to claim 1, wherein the drive motor is a single-phase or three-phase AC motor.

10. The countercurrent swimming system according to claim 1, wherein at least one
suction nipple is provided on the rear of the housing box.

11. The countercurrent swimming system according to claim 1, wherein at least one circulation nipple is provided on the rear of the housing box.

12. A swimming bath comprising:

a countercurrent system, wherein the countercurrent system includes: a rectangular housing box having an end face, said end face being provided with a central water outlet opening and a left-side water inlet opening extending to the left of said water outlet opening and a right-side water inlet opening extending to the right of said water outlet opening, wherein a width of said left-side water inlet opening and a width of said right-side water inlet opening are each at least twice the diameter of said central water outlet opening;

a propeller for generating a water flow which is arranged in a flow channel, the flow channel opening into said central water outlet opening downstream of the propeller and hydraulically communicating with said left-side and said right-side water inlet openings upstream of the propeller; and a drive motor for the propeller, wherein the drive motor is arranged outside of said rectangular housing box and wherein the propeller and the drive motor are coupled to one another via a magnetic coupling.

13. The swimming bath according to claim 12, which comprises a maintenance shaft, wherein the drive motor of the countercurrent swimming system is arranged in a maintenance shaft of the swimming bath.

* * * * *